US005337532A

United States Patent [19]

Reid

[11] Patent Number: 5,337,532

[45] Date of Patent: Aug. 16, 1994

[54] CONCRETE FLOOR SYSTEM

[76] Inventor: Robert C. Reid, 38-40 Albany Street, Crows Nest, New South Wales, 2065, Australia

[21] Appl. No.: 113,960

[22] Filed: Aug. 30, 1993

Related U.S. Application Data

[63] Continuation of Ser. No. 774,574, Oct. 10, 1991, abandoned.

[30] Foreign Application Priority Data

Oct. 11, 1990 [AU] Australia ..... PK2754

[51] Int. Cl.[5] ..... E04C 5/16

[52] U.S. Cl. ..... 52/687; 52/688; 52/340; 52/689; 248/83; 248/163.1

[58] Field of Search ..... 52/687, 688, 689, 685, 52/677, 220–224, 355, 340, 341; 248/163, 80, 83, 175

[56] References Cited

U.S. PATENT DOCUMENTS

| | | | |
|---|---|---|---|
| 1,406,379 | 2/1922 | Hatch | 52/689 |
| 1,880,707 | 10/1932 | Bitney . | |
| 1,903,356 | 4/1933 | Bitney | 52/689 |
| 1,907,477 | 5/1933 | Bauman | 52/689 |
| 2,131,652 | 2/1936 | Young | 52/220.4 |
| 3,132,448 | 5/1964 | Phillips et al. | 52/689 |
| 4,080,770 | 3/1978 | Vigh | 52/689 |
| 4,085,559 | 4/1978 | Ilukowicz | 52/687 |

FOREIGN PATENT DOCUMENTS

| | | | |
|---|---|---|---|
| 56967 | 7/1970 | Australia . | |
| 65399 | 2/1975 | Australia . | |
| 81358 | 7/1980 | Australia . | |
| 2528684 | 3/1984 | Australia . | |
| 343988 | 10/1988 | Australia . | |
| 610387 | 5/1991 | Australia . | |
| 8600358 | 1/1986 | PCT Int'l Appl. . | |
| 8902959 | 4/1989 | PCT Int'l Appl. . | |
| 532236 | 1/1941 | United Kingdom | 52/689 |

*Primary Examiner*—Carl D. Friedman
*Assistant Examiner*—Kien Nguyen
*Attorney, Agent, or Firm*—Ratner & Prestia

[57] ABSTRACT

A concrete floor system includes undulating sheet metal formwork for forming concrete slabs with one or more concrete ribs. The system also provides a unique type of bar chair which allows reinforcement in the form of steel rods, for example, to be dropped in place, thereby minimizing the labor required in installing the formwork.

8 Claims, 5 Drawing Sheets

CONCRETE FLOOR SYSTEM

This application is a continuation of application Ser. No. 07/774,574 filed Oct. 10, 1991 now abandoned.

This invention pertains to suspended concrete floors for building structures formed with "left-in-place" sheet metal form work.

Sheet metal form work for concrete floors is known, but suffers a number of limitations. The existing sheet metal systems mostly produce solid or constant thickness slabs and are normally used in a way which gives limited fire protection to a building. They also are uneconomical in the use of materials and in end coat when used for long-span slabs, and on long spans require more propping than is desirable due to the limited strength and stiffness of the form work.

Furthermore, conventional methods of reinforcing most concrete frame floors, and particularly concrete rib floors, are labour intensive, requiring, for example, the tying of reinforcement with wire ties or the like, and the performance of other complicated duties in the assembly of the formwork. Previously known formwork for rib floors is particularly costly and labour intensive, as is the use of conventional plywood formwork.

It is therefore an object of this invention to obviate or at least mitigate the above disadvantages associated, until now, with "left-in-place" sheet metal formwork. It is also an object of this invention to provide apparatus and method which will enable construction of in-situ concrete floors in a way that is simpler, faster and cheaper than previous systems.

According to the present invention there is provided a concrete floor system comprising a plurality of bar chairs, reinforcement and undulating sheet metal formwork for forming a concrete slab having one or more concrete ribs, wherein the bar chairs are sized to enable a clearance fit between sides of a trough formed from the undulations in the sheet metal formwork and include seating means for supporting the reinforcement.

Preferably, the reinforcement includes steel rods which may be dropped on to the seating means of the bar chairs, said seating means being of sufficient depth to accommodate a minimum of two rods without the undue possibility of dislodgement during assembly or during the pouring of concrete. It is also preferable that the depth of the seating means is, in like manner to the top of the bar chairs, sufficient to enable the bar chairs and the reinforcement to be contained entirely within the depth of the trough of the undulating sheet metal formwork. This is for the dual purpose of optimum structural performance in addition to the prevention of dislodgement by a workman or others walking on the top surface of the formwork.

Preferably, the concrete floor system also includes profiled end closing and beam side forms for supporting beams.

An embodiment of the invention will now be described by way of example only with reference to the accompanying drawings, in which.

Figure 1:
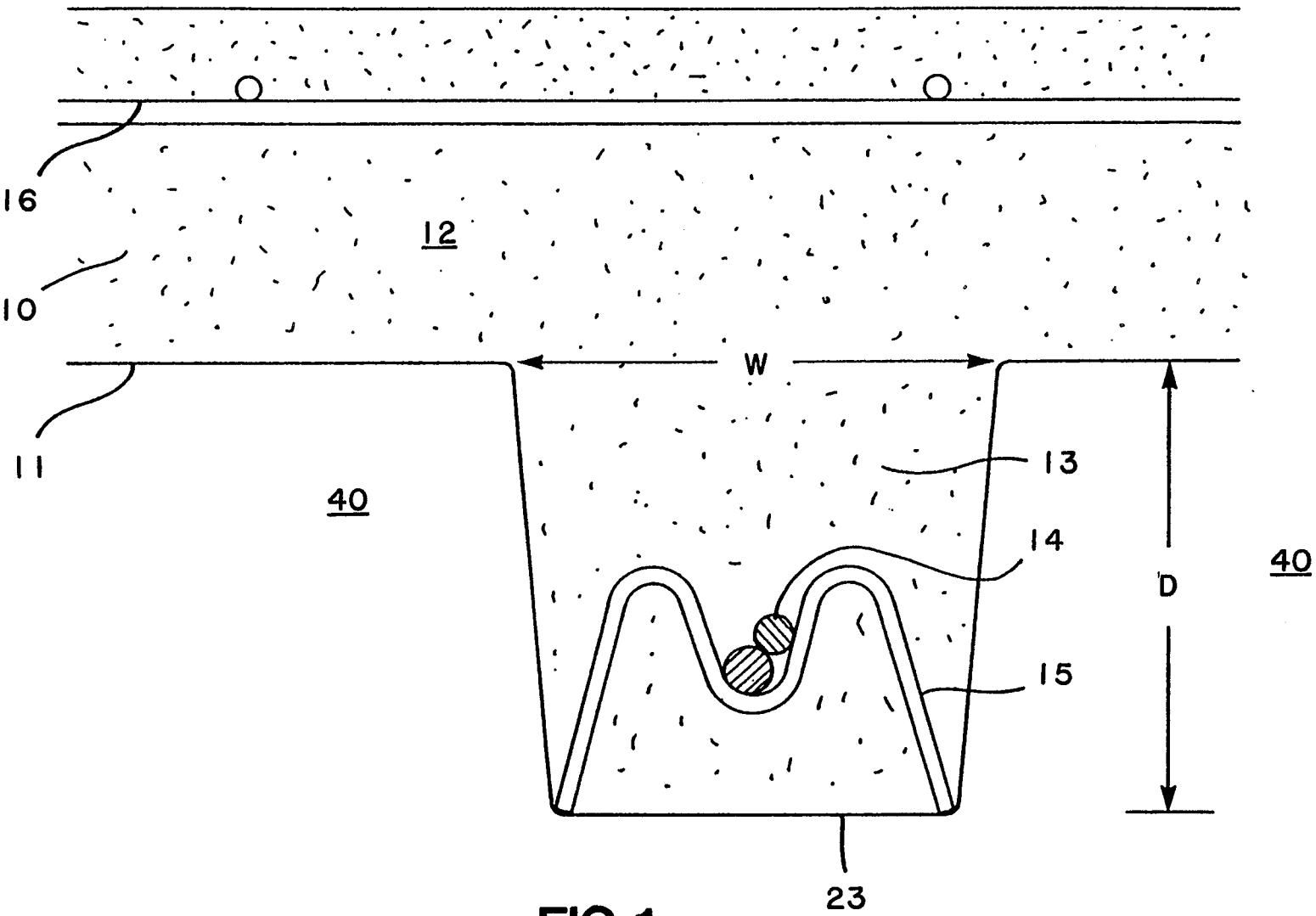
FIG. 1 is a cross-sectional view of a portion of a concrete floor with sheet metal "left-in-place" formwork according to the teachings of the present invention.

As shown in FIG. 1, a concrete floor 10 may be constructed using a sheet metal "left-in-place" formwork 11. The formwork 11 is undulating so as to provide a space or trough which when filled with concrete 12 forms one or more concrete ribs 13. Some or all of the longitudinal ribs 13 may be provided with steel reinforcement 14. Generally, every rib 13 is reinforced with embedded steel rods. Before the concrete 12 is poured, the reinforcement 14 is supported within the ribs 13 by bar chairs 15. The finished floor will usually contain additional reinforcement 16 in the form of a mesh or rods as illustrated with additional reinforcement wire thereto, if and as required.

Figure 2:
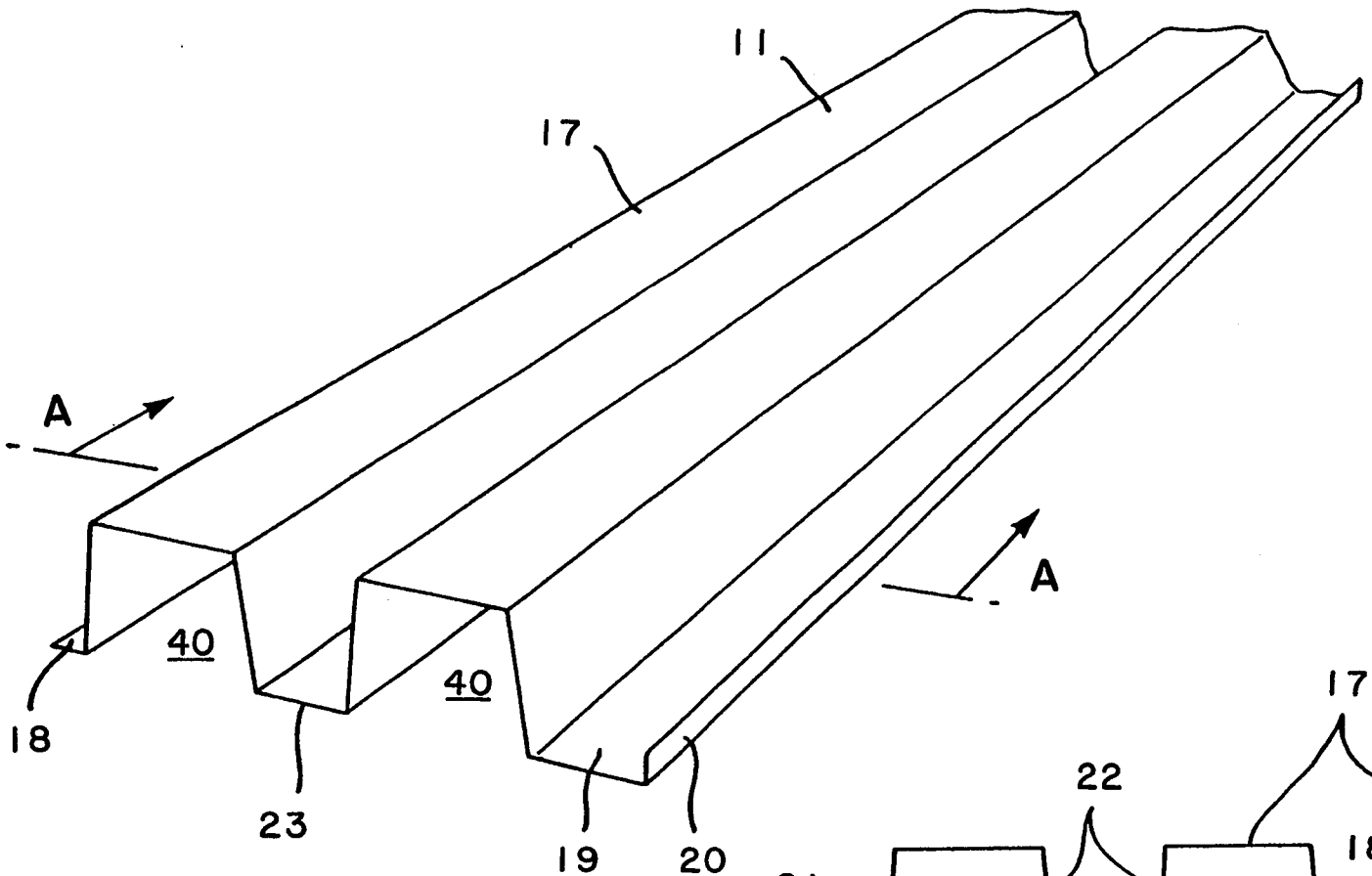
FIG. 2 is a perspective view of a sheet metal form of the present invention.

As shown in FIG. 2, the sheet metal formwork 11 is fabricated in units of any suitable length. Each unit 17 preferably includes two voids 40, a short horizontal extension 18 at one end, a longer horizontal extension 19 at the other end and a short upturned edge 20 which extends from the longer horizontal extension 19.

Figure 3:
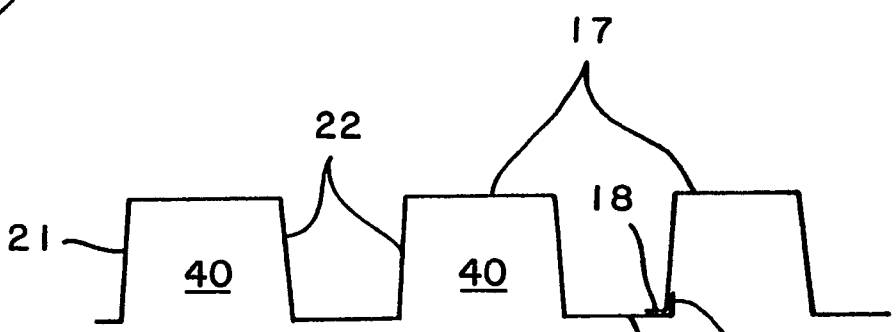
FIG. 3 is a cross-section of a sheet metal form unit according to the present invention.

As shown in FIG. 3, a shorter horizontal extension 18 nests within the corner formed between the short upturned edge 20 and the longer horizontal extension 19. This arrangement creates a pleasing appearance in the finished product but it should be appreciated that the short horizontal extension 18 may be placed outside rather than inside the aforementioned corner. In a preferred embodiment each unit 17, when used in conjunction with an adjacent unit, is preferably capable of forming two ribs 13. Each unit 17 is fabricated from approximately 1.0 mm thick high tensile steel sheet. This combination of module size and sheet thickness has been optimised for maximum performance and ease of handling at the construction site. Units with more ribs are possible but considered cumbersome. A unit forming only one rib will involve more joints, more labour on the building site and more parts than otherwise necessary. Again, in a preferred embodiment all of the generally vertically extending panels are inclined with respect to the true vertical. By tapering these panels 21, 22 which form the lateral sides of the rib 13, the unit 17 may be stacked for facilitating storage and transport.

An additional feature is that the metal formwork is completely free of undue projections on either face of the metal surfaces. Such projections would interfere with the location of reinforcing rods in the concrete ribs, would create difficulty in handling and positioning of the units on site and in the stacking, storage or transport of units.

To obtain wide commercial appeal, a minimum of two-hour fire rating on the concrete ribs formed in necessary in some countries. This determines the minimum proportions of the major metal sheeting components and thus the minimum proportions of the concrete ribs formed.

For achieving a two-hour minimum fire rating, it is necessary that the width of the rib 13 be at least 125 mm across when measured 40 mm approximately from the bottom 23. In a preferred embodiment as shown in FIG. 1 the rib width across the bottom 23 of the rib 13 is about 115 mm to 120 mm. The depth of the rib d is about 130 mm. The width W at the top of the rib 13 is about 140 mm. The rib spacing is about 333 mm between rib centrelines. Dimensions may be varied if required to suit varying requirements of different floors.

Figure 4:
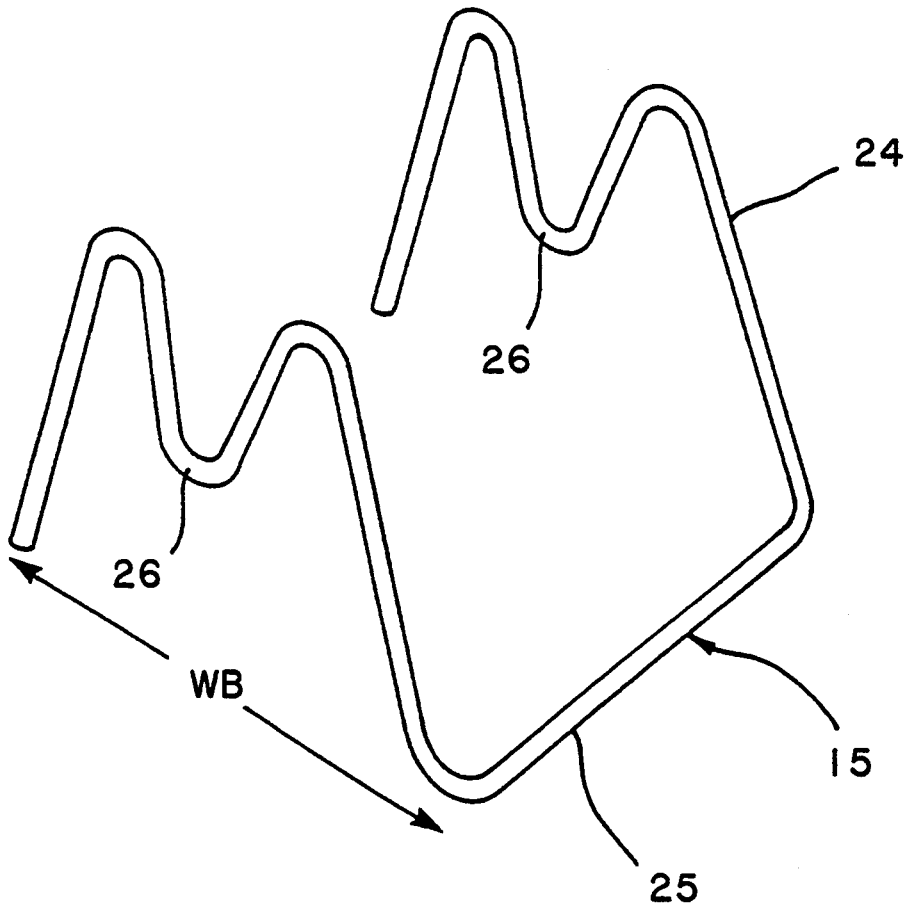
FIG. 4 is a perspective view of a bar chair.

As shown in FIG. 1, to further increase structural strength and to meet the requirements of building and fire codes, one or two reinforcing bars 14 extend along the length of the longitudinal ribs 13. These need to be supported above the bottom 23 of the formwork 11. In general, the reinforcement 14 is normally supported about 35 mm clear above the bottom 23. This also ensures that the reinforcement is contained entirely within the depth of the trough of the sheet metal formwork. In order to accomplish this, a bar chair 15 or other support means may be utilised. While many varieties of support means are compatible with the present invention, a preferred bar chair is depicted in FIG. 4. As shown in FIG. 4, the bar chair 15 includes two generally "M" shaped sides 24 which are interconnected and held apart by an integral horizontal portion 25. Each of the "M" shaped sides include a seating means or deep seat 26 for supporting the reinforcement 14. This deep seat 26 is a unique and essential feature of the bar chair as it will locate and hold the reinforcement securely during the pouring of concrete without the use of wire ties normally required to prevent dislodgement. Yet, at the same time, the design of the bar chairs and in particular the deep seat allow reinforcement rods to be simply dropped in place, the depth of the seat being sufficient to securely hold the reinforcement in the required location. Furthermore, the "M" shape at each side automatically locates the reinforcement rods in position within the ribs so as to provide the desired dimensions of concrete in each direction from the rod.

Another important aspect of the invention is the width WB of the bar chair 15. This is slightly less than the trough width of bottom 23 and thus accurately locates the bar chair 15 and therefore the rib reinforcement at the required height, namely at the centre line of the concrete rib. Yet, the provision of a clearance allows for manufacturing tolerances in both formwork 11 and the bar chair 15 and additionally allows the bar chairs 15 to be "dropped" in place, rather than the labour intensive means which are presently known, such as twisting, typing or springing into position.

Figure 5:
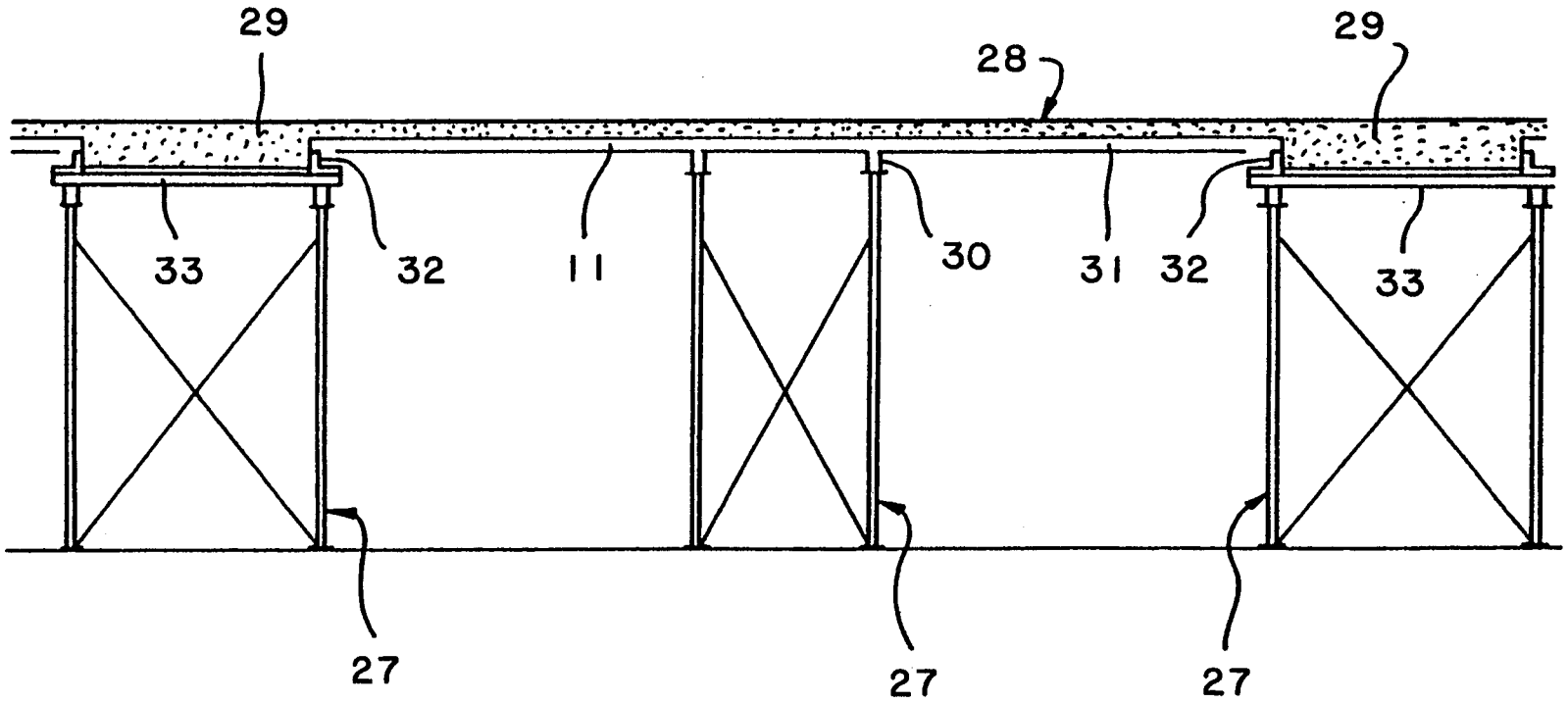
FIG. 5 is a cross-sectional view of a concrete floor showing propping required during the pouring of concrete.

As shown in FIG. 5, a concrete "band-beam" floor is constructed by supporting the various components of the formwork above a number of propping frames 27. The propping frames are usually about 1200 mm wide but this may be varied. Expanses of concrete ribbed floor 28 extend between band-beams 29. The sheet metal formwork 11 of the present invention is supported above bearers 30 which are located on top of the propping frame 27. The assemblage of interconnected metal formwork units 31 may be placed as single units or "ganged", that is, pre-assembled and crane-hoisted into position as pre-assembled panels. An end closure/beam side form 32 supports the end of the metal units 31 and forms a side portion of the band-beam 29. The band-beams 29 are supported above joists 33 located at approximate 450 mm concrete.

Figure 6:
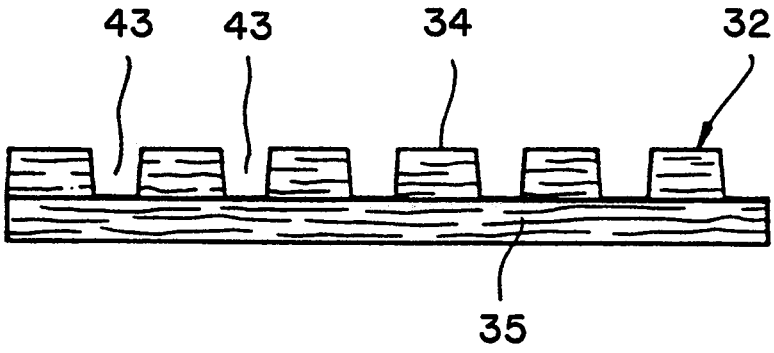
FIG. 6 is a front elevation of a profiled end closing and beam side form used in conjunction with the present invention.
Figure 7:
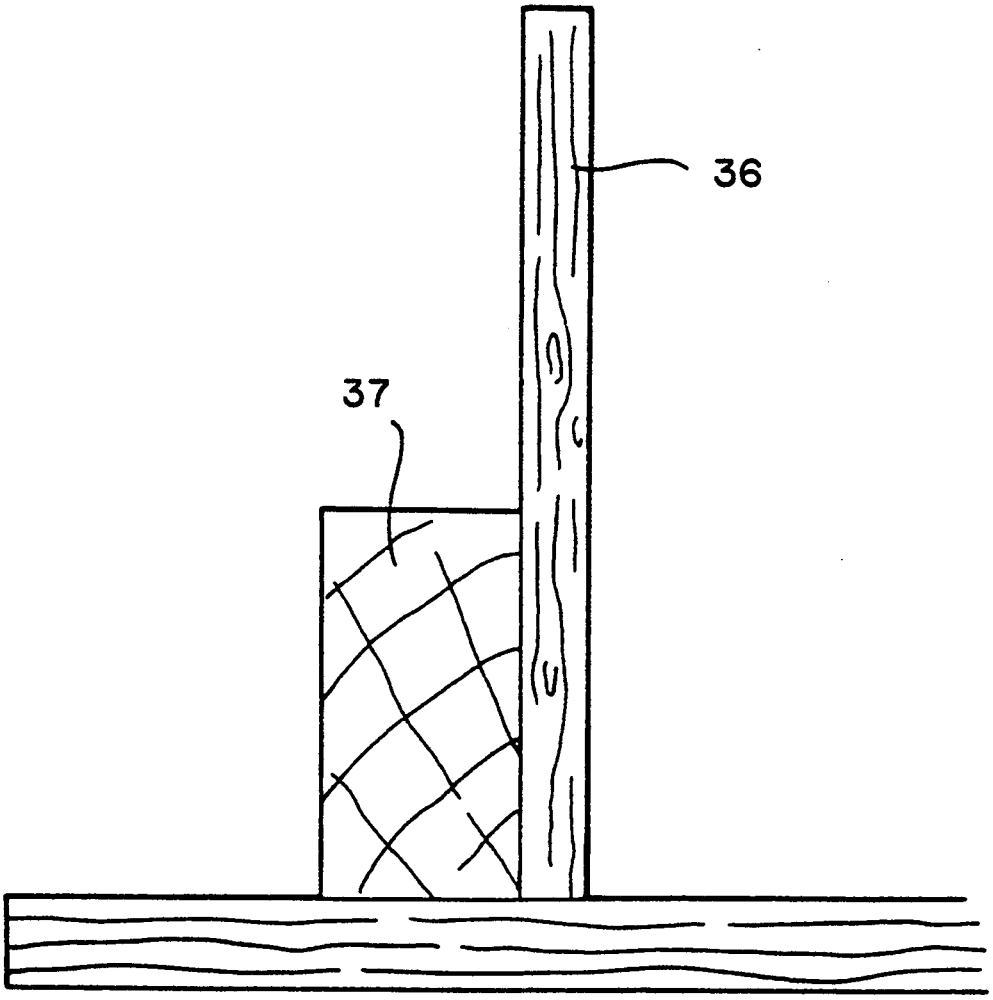
FIG. 7 is a side elevation showing one method of fabricating the profile formwork depicted in FIG. 6.

As shown in FIG. 6, a beam side form 32 includes a series of notches 43 which conform to the cross-sectional profile of the sheet metal formwork 11. The beam side form 32 can be placed end to end, as required or cut into shorter lengths. The construction of the beam side form 32 may comprise a series of blocks 34 attached to a runner 35 as shown in FIG. 6, or may comprise as shown in FIG. 7 a single profile plywood panel 36 attached to a longitudinal support 37. Profiled metal beam side forms may also be used or forms of any other desired material. In accordance with the teaching of the present invention, it should be appreciated that the disclosed components and method provide a very economical, labour saving system for constructing fire rated rib concrete floors. The sheet metal formwork (generally no more than 1 mm thick) provides a strong formwork and strength and stiffness in the finished floor. It is also easy to handle and leaves an attractive appearance. The unique "drop-in" reinforcing procedure ensures that the reinforcement is properly located within the ribs and is extremely simple and labour saving. The total system represents a labour saving of approximately 50% over other in-situ concrete frame floor systems. While its primarily beneficial use is with "band-beam" concrete floors, the system can be applied to a variety of other structural configurations. Reduction of the amount of concrete used in the floor while still achieving desired fire ratings is achieved by having created voids in the finished floor. The formwork profile reduces the concrete to a practical minimum consistent with requirements for two-hour fire ratings using normal concrete and taking maximum advantage of the strength property of the steel sheet. A higher fire rating can be achieved by using light-weight concrete or by increasing the proportions of the concrete ribs formed. As the steel sheeting is much deeper than existing steel sheeting, less propping of the units is required during the pouring phase. It is expected that the metal units of the present invention will span further during temporary propping than other sheet metal formwork currently used in the building industry. Mesh in the top of the slab and in the bottom of band-beams enable additional rod reinforcement to be affixed with an absolute minimum of wire tying. While the overall depth of a concrete slab made in accordance with the teachings of the present invention is variable, the teachings of the present invention provide cost and weight savings through the efficient utilisation of concrete and reinforcement. For example, the overall depth of a rib slab using 100 mm top slab thickness is 230 mm but the average concrete thickness is about 150 mm. Accordingly, about 80 mm thickness of concrete is saved over the rib slab area by using the formwork of the present invention. For most projects, considerable savings would be expected over the cheapest alternative for floors of 6 to 10 m span. Further, the present invention in addition to being more economical with both material and cost, is also faster than other alternate types of concrete floor construction procedures.

While the present invention has been described with reference to particular materials and details of construction, these should be understood as having been provided by way of example only and not as limitations to the scope or spirit of the invention.

The claims defining the invention are as follows:

1. A concrete floor system comprising bar chairs, at least two or more reinforcements and undulating sheet metal formwork, for forming a concrete slab having one or more concrete ribs, the sheet metal formwork including at least one trough comprising respective sides and a base having a base width and formed from undulations in the sheet metal formwork, said bar chairs including seating means for locating and supporting the reinforcements wherein:

(a) the bar chairs have a generally "M" shaped configuration and have a width slightly less than the base width for allowing location of said bar chairs in the trough, such that the bar chairs are able to be freely located within said trough by being dropped thereinto, the width of the bar chairs being sufficient to allow such location and to accurately locate the bar chairs within said trough;

(b) the seating means of each bar chair forms a seat cavity of such width and depth accommodating two or more reinforcements to be freely dropped, placed and maintained entirely within the width and depth of said seat cavity; and (c) the seating means of said bar chairs, the width of the bar chairs and the depth and width of each trough being so formed and dimensioned, such that on said bar chairs being located within said trough, and on said reinforcements being so located and maintained within said seating means, the bar chairs and reinforcements are contained and maintained entirely within the depth of each trough.

2. A concrete floor system as claimed in claim 1, wherein the reinforcements comprise steel rods.

3. A concrete floor system as claimed in claim 1, also comprising profiled end closing and beam side forms for supporting beams.

4. A concrete floor system as claimed in claim 1, wherein each unit of said undulating sheet metal formwork is adapted to provide two concrete ribs.

5. A concrete floor system as claimed in claim 1, wherein said undulating sheet metal formwork is fabricated from approximately 1 mm thick high-tensile steel sheet.

6. A concrete floor system as claimed in claim 1, wherein said undulating sheet metal formwork is designed such that all of the generally vertically extending sides are inclined with respect to the true vertical to facilitate stacking, storage and transport.

7. A concrete floor system as claimed in claim 1, wherein said undulating sheet metal formwork has a surface which is completely free of undue projections on either face thereof.

8. A concrete floor system as claim in claim 1, for forming a concrete slab having a minimum of two-hour fire rating.

* * * * *

UNITED STATES PATENT AND TRADEMARK OFFICE

CERTIFICATE OF CORRECTION

PATENT NO. : 5,337,532
DATED : August 16, 1994
INVENTOR(S) : Robert C. Reid

It is certified that error appears in the above-identified patent and that said Letters Patent is hereby corrected as shown below:

Column 5,
In claim 1, line 14, after "reinforcements", insert --and to allow the reinforcements--.

Column 6,
In claim 8, line 22, "claim", first occurrence, should be --claimed--.

Signed and Sealed this

Twenty-second Day of November, 1994

*Attest:*

Bruce Lehman

BRUCE LEHMAN

*Attesting Officer*

*Commissioner of Patents and Trademarks*